US008347459B2

(12) United States Patent
Heisig

(10) Patent No.: US 8,347,459 B2
(45) Date of Patent: Jan. 8, 2013

(54) HINGE

(75) Inventor: Rolf Heisig, Reutlingen (DE)

(73) Assignee: PRÄMETA GmbH & Co. KG, Troisdorf (DE)

( * ) Notice: Subject to any disclaimer, the term of this patent is extended or adjusted under 35 U.S.C. 154(b) by 265 days.

(21) Appl. No.: 11/918,720

(22) PCT Filed: Apr. 28, 2006

(86) PCT No.: PCT/EP2006/061908

§ 371 (c)(1),
(2), (4) Date: Oct. 18, 2007

(87) PCT Pub. No.: WO2006/117334

PCT Pub. Date: Nov. 9, 2006

(65) Prior Publication Data

US 2009/0038118 A1 Feb. 12, 2009

(30) Foreign Application Priority Data

Apr. 29, 2005 (DE) ..... 10 2005 020 508
Apr. 29, 2005 (DE) ..... 10 2005 020 509

(51) Int. Cl.
*E05D 7/04* (2006.01)

(52) U.S. Cl. ..... 16/246; 16/236; 16/238; 16/245

(58) Field of Classification Search ..... 16/235, 16/236, 237, 238, 240–243, 245, 246, 248
See application file for complete search history.

(56) References Cited

U.S. PATENT DOCUMENTS 2,725,589 A * 12/1955 Papesh ..... 16/236
4,159,557 A 7/1979 Pittasch et al.
4,293,976 A 10/1981 Pittasch et al.
4,620,343 A * 11/1986 Grass ..... 16/236
4,703,539 A * 11/1987 Lautenschlager et al. ..... 16/240
4,760,623 A * 8/1988 Toyama ..... 16/238
4,817,241 A 4/1989 Koch et al.
4,937,917 A * 7/1990 Rock et al. ..... 16/245

(Continued)

FOREIGN PATENT DOCUMENTS

FR 2368596 5/1978

(Continued)

OTHER PUBLICATIONS

Abstract of European Search Report dated Mar. 23, 2011, in counterpart European Patent Application No. 10 18 5190.

*Primary Examiner* — Roberta Delisle
(74) *Attorney, Agent, or Firm* — Miles & Stockbridge P.C.; David R. Schaffer, Esq.

(57) ABSTRACT

A hinge (1) has a carcass-side hinge portion (4) which can be pre-mounted on a furniture carcass (2) and a hinge portion (6) which can he pre-mounted on a door wing (3), the hinge portions (4, 6) being joined together in an articulated manner and at least one of the hinge portions (4, 6) having height adjustment means (10) and/or a lateral adjustment means (5). The hinge portion (6) mounted on the door has a hinge cup (8) in which the height adjustment means (10) are arranged, and at least one locking element (17) for immobilising the door wing (3) in relation to the furniture carcass (2) at the set vertical position of the door wing (3).

17 Claims, 5 Drawing Sheets

U.S. PATENT DOCUMENTS

| | | | | |
|---|---|---|---|---|
| 5,052,077 | A * | 10/1991 | Lautenschlager et al. | 16/238 |
| 5,099,547 | A | 3/1992 | Salice | |
| 5,444,895 | A * | 8/1995 | Salice | 16/278 |
| 5,493,759 | A * | 2/1996 | Salice | 16/238 |
| 5,511,287 | A * | 4/1996 | Lautenschlager et al. | 16/239 |
| 5,799,370 | A * | 9/1998 | Davidian et al. | 16/236 |
| 5,930,866 | A * | 8/1999 | Rupprechter | 16/242 |
| 6,049,946 | A * | 4/2000 | Cress et al. | 16/240 |
| 6,615,452 | B2 * | 9/2003 | Mueller et al. | 16/242 |
| 6,694,567 | B1 * | 2/2004 | Domenig et al. | 16/238 |
| 6,845,544 | B2 * | 1/2005 | Hofer | 16/246 |
| 2001/0023519 | A1 * | 9/2001 | Muller et al. | 16/235 |
| 2002/0166207 | A1 * | 11/2002 | Egger et al. | 16/240 |
| 2004/0025293 | A1 * | 2/2004 | Salice | 16/245 |
| 2004/0034965 | A1 * | 2/2004 | Mueller et al. | 16/242 |

FOREIGN PATENT DOCUMENTS

| | | |
|---|---|---|
| GB | 2 377 729 A | 1/2003 |

* cited by examiner

HINGE

BACKGROUND OF THE INVENTION

The invention is directed to a hinge having a furniture carcass-side hinge portion adapted to be preassembled to a furniture carcass and a door-side hinge portion adapted to be preassembled to a door wing.

Multi-link hinges often have the possibility of three-dimensional adjustment at the frame part in a hinge arm and, due to the link mechanism, generally have a restricted opening angle. Since multi-link hinges have no parts visible from outside, a correction of the door position achieved by the adjustment of the hinges is not discernible from outside.

Due to an outside axis, single axis hinges have a large opening angle of 180-270°, for example. Typically, they are provided with a two-dimensional adjustment comprising a height adjustment at the furniture carcass-side hinge portion and a lateral adjustment in the door-side hinge portion. Rarely, a depth adjustment is realized at the carcass-side hinge portion by means of fastening screws situated in oblong holes. Since the lateral adjustment can be realized in the door-side hinge portion, single axis hinges may have a furniture carcass-side hinge portion lying flat on the furniture carcass, most frequently taking the form of a flat flange plate.

By incorporating all adjustment means for three-dimensional adjustment in the furniture carcass-side hinge portion, multi-link hinges become complex, whereby their structure is high with respect to the furniture carcass. The lateral adjustment is realized as a rotation about a pivot point located within the furniture carcass-side hinge portion, whereby the lateral adjustment also entails a change in the depth setting. Multi-link hinges exist that attempt to avoid a simultaneous depth adjustment by means of additional components. Thus, the structure of the furniture carcass-side hinge portion becomes even more intricate and the structural height would be even larger. For large opening angles, further links are required which also results in complex designs increasing the structural height of the furniture carcass-side hinge portion. Thus, in cabinets with organizing means, the use of such multi-link hinges is greatly impeded or outright impossible.

With single axis hinges, the outside axis is situated far on the outside, especially if an opening angle of up to 270° is desired. If a correction of the position of the door wing is necessary, the elements receiving the link axis are changed in their position visible from outside with respect to the door wing or adjacent link axes, as can be seen in FIG. 1, for example. In the event of a necessary lateral adjustment, a gap is formed between the elements receiving the link axis and the door wing, and after a height adjustment, the elements receiving the link axes of neighboring cabinets are at different vertical positions. With double hinges, a height adjustment is only possible for both doors together.

SUMMARY OF THE INVENTION

It is thus an object of the invention to provide a three-dimensional adjustment of the hinges in a hinge of the above mentioned type and to avoid the disadvantages mentioned above.

The invention advantageously provides that the height adjustment means is arranged in the hinge cup of the door-side hinge portion and comprises at least one locking element with which the set vertical position of the door wing can be fixed with respect to the furniture carcass.

Relocating the height adjustment to the hinge cup of the door-side hinge portion advantageously allows for a simplification of the furniture carcass-side hinge portion with the result that a low structural height of the furniture carcass-side hinge portion on the frame becomes possible. With a three-dimensional adjustment, it is not discernible from outside whether an adjustment has been made or not, regardless, whether a multi-link hinge or a single axis hinge is used.

Arranging the height adjustment means in the hinge bowl of the door-side hinge portion offers the advantage that the elements of the furniture carcass-side hinge portion receiving the link axis remain fixed and that their vertical position is left unchanged.

Here, the furniture carcass-side hinge portion and/or the door-side hinge portion may include a lateral adjustment means.

The depth arrangement means may be provided at the furniture carcass-side hinge portion.

Preferably, the hinge is a single axis hinge with a single link axis. The effected distribution of the adjustment means to the furniture carcass-side hinge portion and the hinge cup of the door-side hinge portion advantageously allows for a flat structure of the singles axis hinge.

The furniture carcass-side hinge portion comprises a fork member receiving the link axis and a connecting member pivotably hinged to the fork member.

The invention advantageously also provides that the lateral adjustment means pivots the furniture carcass-side hinge portion about an imaginary pivot axis situated in the furniture carcass and extending in parallel with the link axis.

The lateral adjustment at the furniture carcass-side hinge portion allows to adjust the elements receiving the link axis to be adjusted such that no gap can form between the elements receiving the link axis and the door wing.

The lateral adjustment at the furniture carcass-side hinge portion has as a consequence that while the lateral position of the door wing is corrected, not only the door wing but also the fork member and the connecting member move along. Thereby, the effective adjustment range is increased substantially. Since the elements receiving the link axis are co-adjusted, a better correction of the position of the neighboring door becomes possible, where, in particular, no gap is formed between the elements receiving the link axis and the door wing.

The lateral adjustment means is preferably arranged in the furniture carcass-side hinge portion. Pivoting the furniture carcass-side hinge portion about a pivot axis located in the furniture carcass has the effect that the lateral adjustment can not create a gap between the elements receiving the link axis and the door wing, because the door wing is moved along upon lateral adjustment.

In the lateral adjustment area, the rotation about the pivot axis situated in the furniture carcass causes a negligible small change in the depth position of the furniture carcass-side hinge portion so that no additional corrective measures or correction members are required.

The lateral adjustment is set by manipulating a lateral adjustment element, preferably a self-locking adjustment element, e.g. a setting screw.

Finally, the depth adjustment at the furniture carcass-side hinge portion allows for a relative displacement of the furniture carcass-side hinge portion towards the furniture carcass, thus allowing a large opening angle given the outside link axis.

The connecting member may be set into the hinge cup, the connecting member being vertically displaceable in the hinge cup along guide means, either manually or by means of a height adjustment element, and being lockable at a desired position using the locking element. Arranging the height adjustment means in the hinge cup of the door-side hinge portion allows for a vertical correction of the door wing's position without changing the position of the furniture carcass-side hinge portion and the links receiving the link axis. With a double hinge, the height adjustment can be effected individually for each door.

The depth adjustment allows for a correction of positional changes of the furniture carcass/door wing material used and completes the adjustability of the hinge to be a three-dimensional adjustability.

The part of the furniture carcass-side hinge portion resting on the furniture carcass is a plate-shaped flat design and has a low structural height with respect to the furniture carcass. The structural height can be limited to a maximum of 7 mm, preferably to a maximum of 5 mm.

The furniture carcass-side hinge portion and the door-side hinge portion may be firmly connected with each other. As an alternative, the hinge portions are releasably coupled using one or more additional elements. The coupling can either be effected using screw connections or a clip connection that allows for a fast mounting. Here, it is preferably provided that the clip connection is arranged in the door-side hinge portion, preferably in the hinge cup thereof.

The height adjustment means may include a height adjustment element comprising at least one eccentric, for example, which is supported at the hinge cup such that the door-side hinge portion changes its vertical position by rotating the eccentric.

Alternatively, two eccentric elements can receive the connecting member between them, wherein the position of the connecting member can be changed in the vertical direction within a clearance of the hinge cup by adjusting both eccentrics and can be fixed using the eccentrics.

According to another embodiment, it may be provided that the height adjustment element comprises a pinion supported in the connecting member meshing with a straight toothing of a guide means in the hinge cup extending in parallel with the vertical direction.

The connecting member is adapted to linear guide means such that it is vertically displaceable within a clearance in the hinge cup and fixable at a desired vertical position by means of the locking element.

The locking element preferably is a set screw with which the connecting member can be fixed at the desired position relative to the hinge cup.

The height adjustment means in the hinge cup can either provide for a manual displacement of the door wing or use a height adjustment element. Here, the height adjustment element may comprise at least one eccentric supported at the hinge cup such that the door-side hinge portion changes its vertical position when the eccentric is rotated.

Here, one may also provide two eccentrics arranged on either side of a connecting member of the furniture carcass-side hinge portion and adapted to change the vertical position of the connecting member when both eccentrics are rotated.

As an alternative, the height adjustment element may also comprise a pinion meshing with a straight toothing of the guide means in the hinge cup extending in parallel with the direction of height adjustment.

The locking element may be formed by a screw fixing the connecting member at the present position when the screw is tightened so that the door wing is fixed at the present position.

It may be provided for the lateral adjustment that the lateral adjustment means has a cylindrical surface, whose cylinder axis is the imaginary pivot axis situated in the furniture carcass. The cylindrical surface is a guide surface for pivoting the furniture carcass-side hinge portion. The pivot axis extends in parallel with the at least one link axis of the hinge.

The depth adjustment means may comprise a releasable locking means that, in the locking position, retains the furniture carcass-side hinge portion in a middle position relative to fastening screws sitting in mounting holes that are oval in the depth direction. Such an adjustment means is basically described as a height adjustment means already in EP 1132560 and may be used—rotated by 90°—as a depth adjustment means in the present hinge.

The clip connection includes a spring element that is integral with the hinge cup and, together with the connecting member, forms a locking connection allowing for the height adjustment of the door wing. Such a clip connection reduces the manufacturing effort and is more economic to produce, the spring element being engaged in the connecting member or a hinge arm of the hinge such that a height adjustment with respect to the connecting member or the hinge arm is not impeded. This is made possible by the spring element reaching over a protrusion on the connecting member or the hinge arm, while, below the spring element, the hinge cup may still slide vertically on the connecting member or the hinge arm along a guide.

The invention further refers to a hinge cup for a hinge wherein a furniture carcass-side hinge portion and a door-side hinge portion are hingedly connected and are coupled by means of a clip connection. The clip connection includes a spring element that is integral with the hinge cup and, together with the connecting member to the furniture carcass-side hinge portion or hinge arm, forms a locking connection allowing for a height adjustment of the connecting member.

The following is a detailed description of embodiments of the invention with reference to the drawings.

DETAILED DESCRIPTION OF THE PREFERRED EMBODIMENTS

Figure 1:
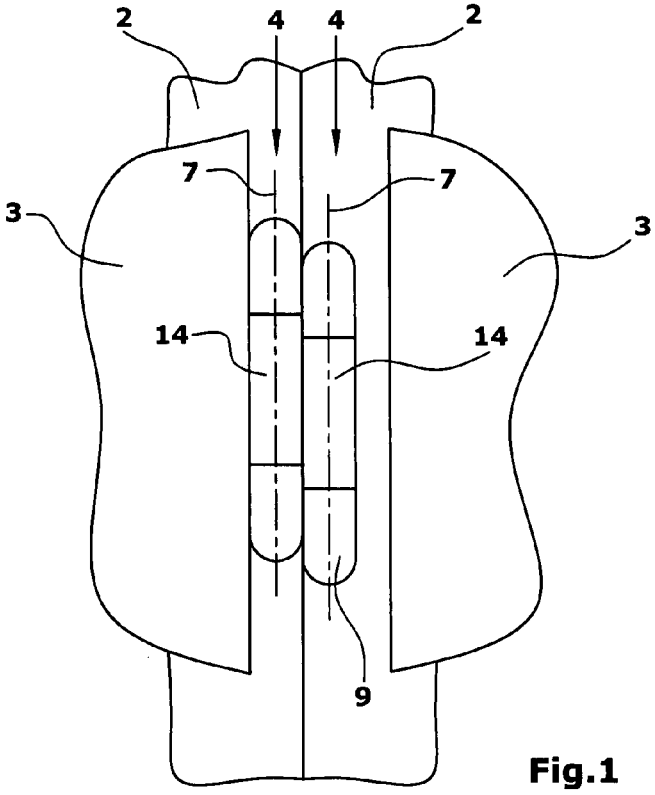
FIG. 1 illustrates the effect of a height adjustment and a lateral adjustment in a conventional single axis hinge.

FIG. 1 illustrates the unwanted effects occurring in a height adjustment and a lateral adjustment using a prior art single axis hinge.

In FIG. 1, two single axis hinges 1 lie side by side, each connecting a door wing 3 with a frame or a furniture carcass 2. The furniture carcass-side hinge portion 4 comprises a fork member 9 receiving the link axis 7 and a connecting member 14 to the door-side hinge portion 6, hingedly received in the fork member 9. With a single axis hinge, these hinge elements are visible from outside. Upon a height adjustment of the furniture carcass-side hinge portion 4, the position of the hinge elements receiving the link axis 7 is displaced, so that, as can be seen in FIG. 1, adjacent hinges 1 are not at the same height, whereby the aesthetic appearance of a piece of furniture can be impaired a lot.

The effects of a conventional lateral adjustment are illustrated on the right, where upon a correction of the lateral adjustment a gap may be formed between the hinge elements receiving the link axis 7 and the door wing 3, which may also compromise the aesthetic appearance of a piece of furniture.

Figure 2:
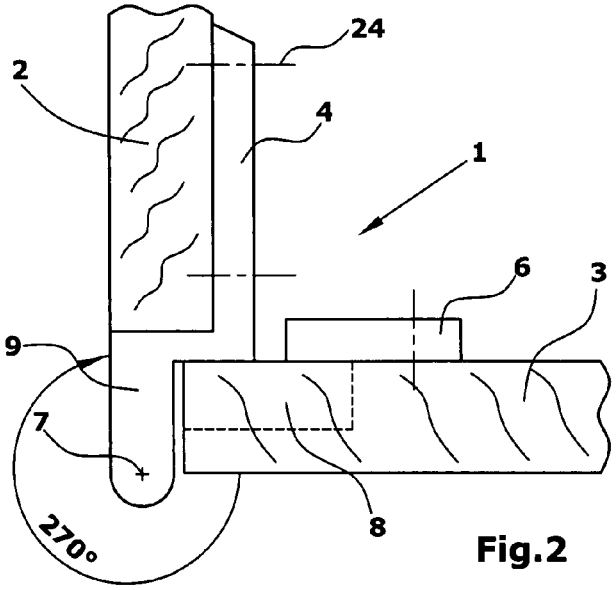
FIG. 2 is a section through a furniture carcass and a door wing in the area of a single axis hinge.

FIG. 2 is a cross section of the hinge 1 showing that both the furniture carcass-side hinge portion 4 and the door-side hinge portion have a flat structure with respect to the furniture carcass 2 or the door wing 3. The door-side hinge portion 6 comprises a hinge cup 8 sunk into the door wing 3.

Figure 3:
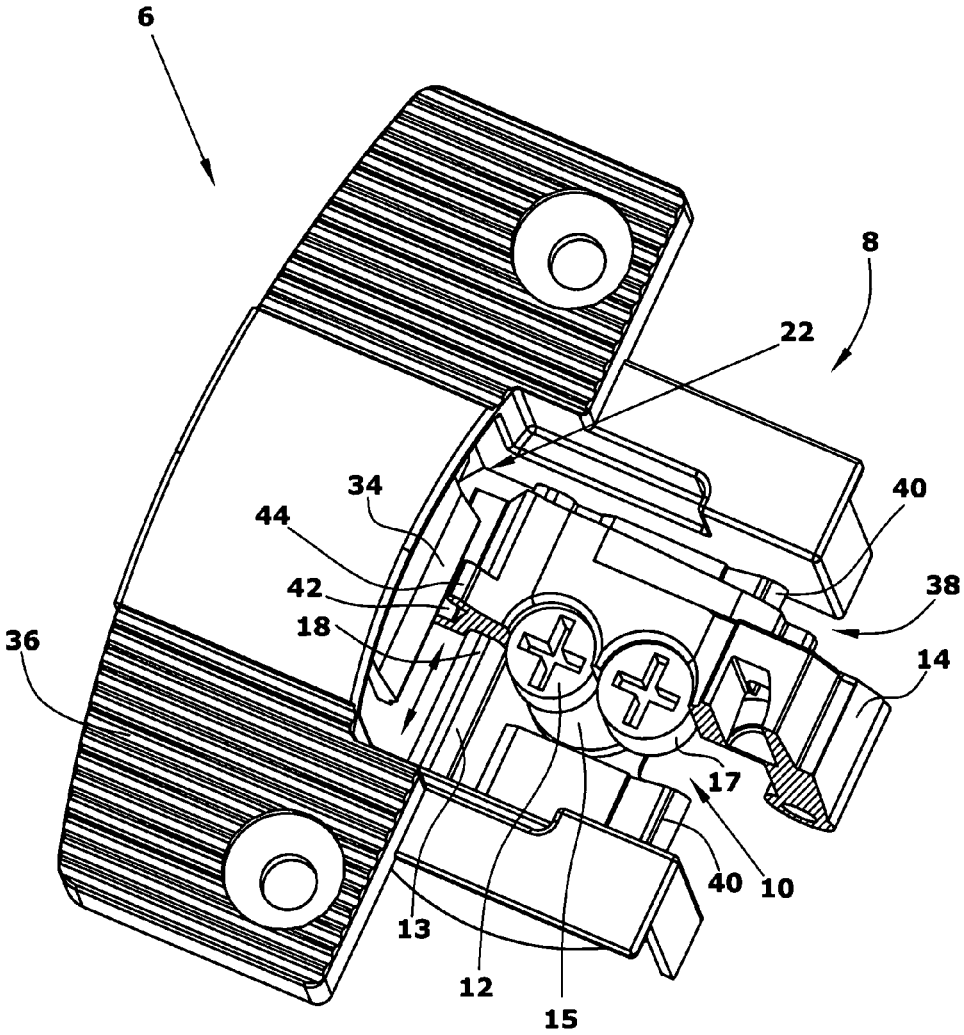
FIG. 3 is a perspective view of the door-side hinge portion having a vertically adjustable connecting member.

This hinge cup 8 is illustrated in perspective in FIG. 3. The hinge cup 8 stationarily mounted in a recess in the door wing 3 using a flange portion 36 integrally connected with the hinge cup, the hinge cup 8 having a clearance 38 allowing the connecting member 14 of the furniture carcass-side hinge portion 4 or a hinge arm of a multi-link hinge to take different positions in the direction of height adjustment in the hinge cup 8, whereby the door wing 3 can be vertically adjusted while the connecting member 14 or the hinge arm is held stationary. For blocking, the connecting member 14 or the hinge arm of a multi-link hinge comprises a locking element 17, e.g. formed by a set screw, fixing the connecting member 14 or the hinge arm at a particular desired position relative to the hinge cup 8. The hinge cup 8 has guide means 13 in engagement with the connecting member 14 or the hinge arm and forming a linear guide in the direction of height adjustment. In FIG. 3, the guide means 13 are formed by a straight rail element cooperating with a recess 18 of the connecting member 14 adapted to this rail element. The height adjustment means 10 formed by these elements comprises at least one locking element 17, it being possible to manually move the door wing 3 to a desired position even without a height adjustment element 12 and to block it with the locking element 17.

Alternatively, a height adjustment element 12 may be provided having an eccentric 15 supported on the hinge cup 8. By turning the eccentric 15, the vertical position of the door wing 3 can be adjusted relative to the connecting member 14 or a hinge arm, whereafter it can be locked using the locking element 17.

It is understood that the height adjustment means 10 may take many different forms.

For example, the eccentric may be replaced with a pinion meshing with a tooth rack provided at the guide means 13 or extending in parallel with the same. A height adjustment of the door wing 3 can then be made by rotating the pinion.

It is another alternative to provide a respective eccentric 15 above and below the connecting element 14 or the hinge arm so that a total of two height adjustment elements are provided which both have to be adjusted for an adjustment of the vertical position of the door wing 3. Since both eccentrics supported in the hinge cup 8 may be biased against the connecting member 14, they simultaneously form the locking element 17 so that an additional set screw can be omitted.

The hinge cup 8 further accommodates a clip connection 22 by means of which the connecting member 14 or the hinge arm may be clipped into the hinge cup. To achieve this, the connecting member 14 is hooked in at a first position 40 in the hinge cup and resiliently latched at a second position 42. To this end, the hinge cup 8 has a spring element 34 integrally formed to the hinge cup 8 and protruding from the flange part 36 towards the clearance 38 of the hinge cup 8. A protrusion 44 provided at the hinge portion 6 serves to release the clip connection 22, e.g. using a tool.

With this tool, the spring element 34 can be pushed back, for example, whereby the connecting member 14 or the hinge arm is released.

The distinctive feature of this locking connection is that it does not interfere with a height adjustment of the door wing 3, since the spring element 34 can slide along the lower edge thereof with respect to the connecting member 14 or the hinge arm.

Figure 4:
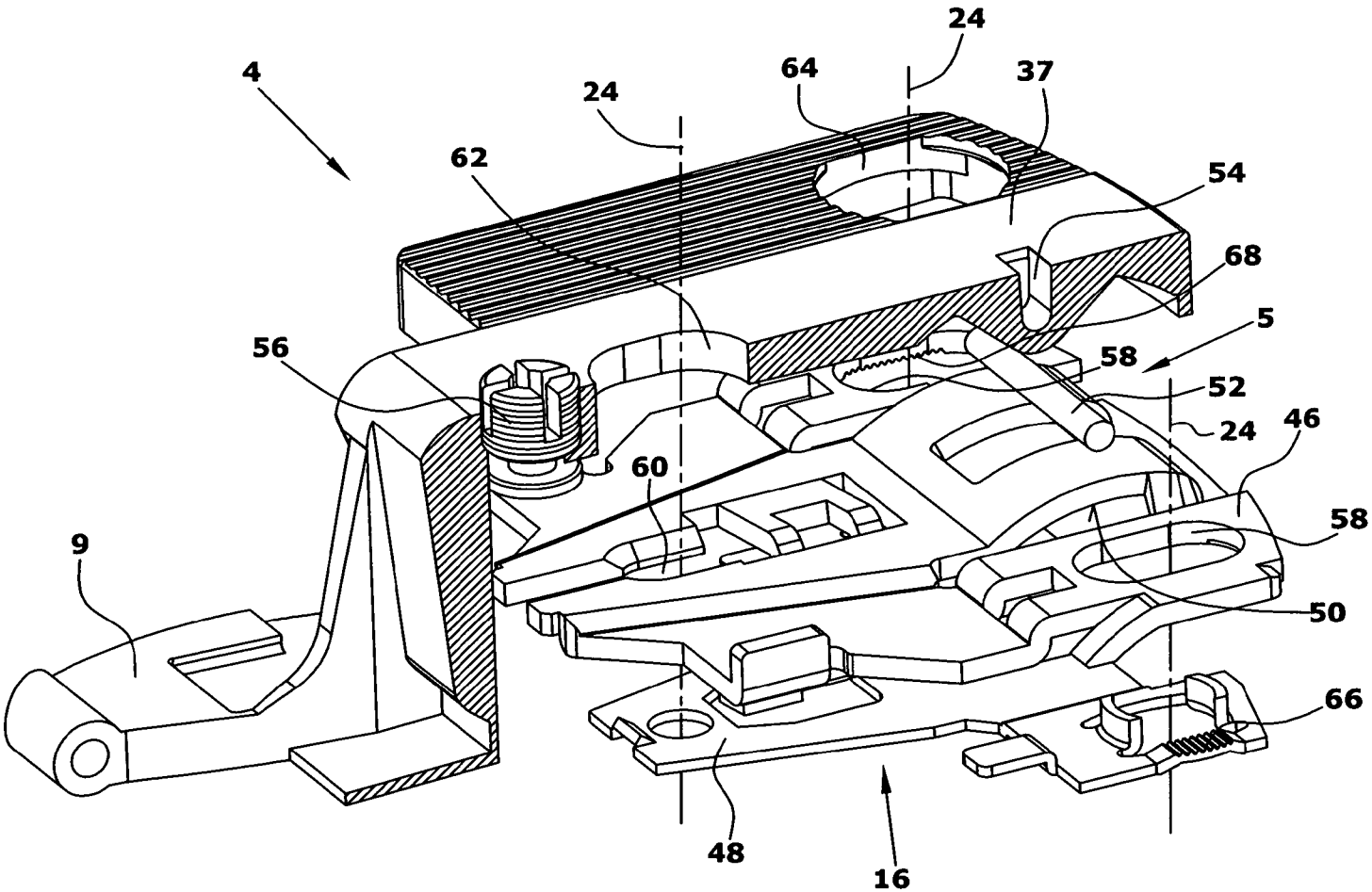
FIG. 4 is an exploded illustration of a lateral adjustment means of the furniture carcass-side hinge portion.

FIG. 4 illustrates the furniture carcass-side hinge portion 4 without the connecting member 14. Only one half of the fork member 9 is illustrated, since the flange part 37 of the furniture carcass-side hinge portion 4 has been cut and only the left half is represented.

The furniture carcass-side hinge portion 4 thus comprises the flange part 37 cooperating with a base plate 46, which in turn is fastened directly on the furniture carcass 2, or which, in the event the furniture carcass-side hinge portion 4 has a depth adjustment means 16, is adapted to be arranged at different depth positions on a depth adjustment plate 48 stationarily fastened on the furniture carcass 2.

FIG. 4 is an exploded view illustrating the integration of a lateral adjustment means 5 and a depth adjustment means 16 into the furniture carcass-side hinge portion 4, wherein a low structural height of the furniture carcass-side hinge portion 4 can be maintained.

The maximum structural height of the flange part 37 relative to the furniture carcass 2 is 7 mm at most, preferably 5 mm.

The lateral adjustment means 5 illustrated in FIG. 4 is formed by a cylindrical surface 50 cooperating with a pin 52 sitting in a pin receptacle 54 of the flange part 37 and being guided on the inner cylindrical surface 50 when an adjustment screw 56 is manipulated. Using the adjustment screw 56 supported in the flange part 37, the distance at the furniture carcass edge is set relative to the base plate 46, whereby lateral adjustment becomes possible. The radius of curvature of the cylindrical surface is chosen such that the flange part 37 is pivoted about an imaginary pivot axis 11 situated in the furniture carcass 2.

It is understood that other mechanical solutions can be realized as well, it being important that the flange part 37 of the furniture carcass-side hinge portion 4 is pivotable about a pivot axis 11 situated in the furniture carcass 2.

The solution principle for a lateral adjustment is generally also applicable to multi-link hinges.

Figure 5A:
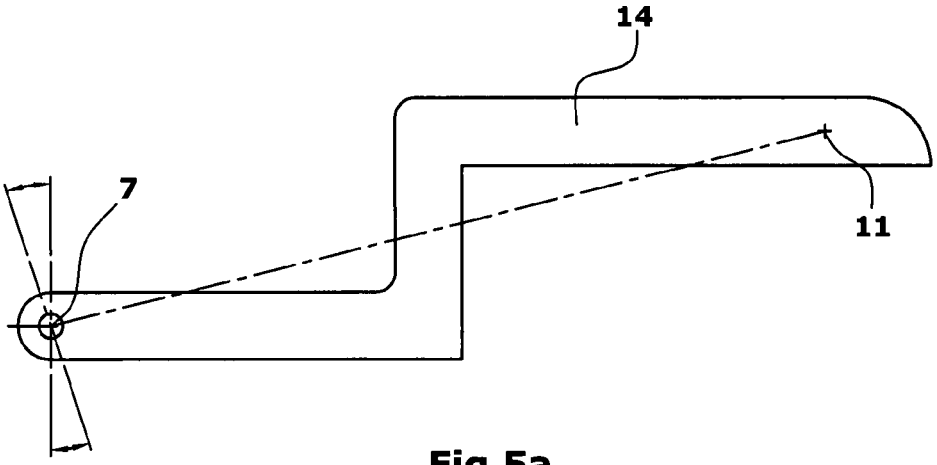
FIG. 5*a* illustrates the lateral adjustment in a conventional hinge.
Figure 5B:
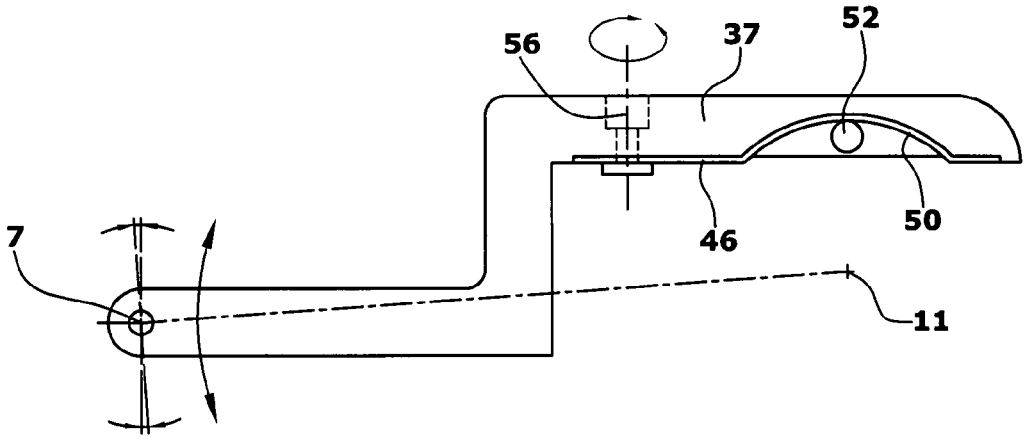
FIG. 5*b* shows an embodiment of a lateral adjustment according to the invention.

FIGS. 5*a* and 5*b* contrast a known lateral adjustment means (FIG. 5*a*) with the novel solution principle. It is evident from FIG. 5*a* that the pivot axis 11 of the prior art furniture carcass-side hinge portion 4 is provided in the furniture carcass-side hinge portion 4. As a result, when a lateral adjustment is performed, the link axis 7 will move away from the door wing 3 by a larger distance.

As is evident from FIG. 5*b*, the solution according to FIG. 4 results in a lesser positional error of the link axis 7 with respect to the door wing 3 than does prior art, it being an additional advantage that the depth adjustment need not be corrected because of the lateral adjustment.

In the assembled state of the furniture carcass-side hinge portion 4, the pin 52 rests on the inner cylindrical surface 50 which faces the furniture carcass 2. To achieve this, the base plate 46 is connected with the flange part 37, the adjustment screw 56 for the lateral adjustment being hooked beneath the base plate 46. Thereafter, the pin 52 is pressed into pin receptacle 54 of the flange part 37 so that the parts are movable with respect to each other, but are permanently connected with each other. Instead of the pin 52, other connecting elements may be used as well, with which the parts can be connected with each other, however, in a permanent manner.

The depth adjustment plate 48 is mounted stationarily at the furniture carcass 2.

In the shipping state of the hinge 1, the depth adjustment means 16 ids locked in a middle position and may be unlocked should a depth adjustment be required. In this case, the base plate with the flange part 37 may be shifted in the depth direction with respect to the depth adjustment plate 48. To achieve this, both the base plate 46 and the flange part 37 have oblong holes 58, 60, 62, 64 so that a depth adjustment can be effected. The position of the base plate 46 with the flange part 37 relative to the depth adjustment plate 48 is set by means of matched toothings 66, 68 of the base plate 46 and the depth adjustment plate 48, respectively, as soon as the three fastening screws 24 have been tightened.

Figure 6:
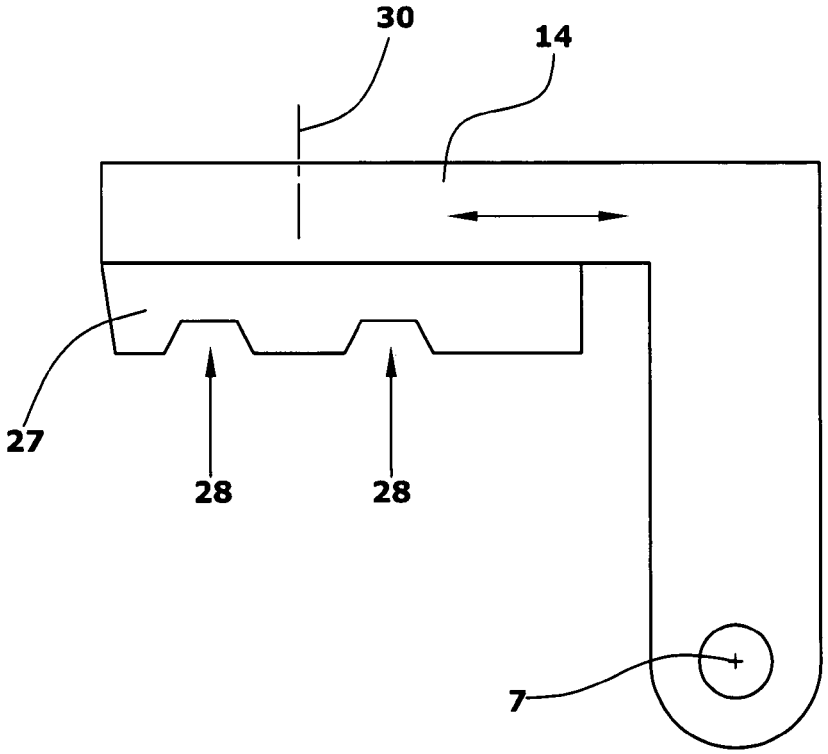
FIG. 6 illustrates a connecting member with an adapter for allowing a lateral adjustment in the door-side hinge portion.

FIG. 6 illustrates an alternative possibility for a lateral adjustment which can be effected in the hinge cup 8 of the door-side hinge portion 6. To this end, the connecting member 14 is provided with an adapter 27 allowing a displacement of the connecting member 14 using a fastening screw guided in an oblong hole. The adapter 27 has grooves 28 in its bottom face which may be in engagement with the guide means 13 that is formed by guide rails, as generally illustrated in FIG. 3.

In a vertically adjustable hinge 1 with a height adjustment means 10 provided in the hinge cup 8, this lateral adjustment may be the sole lateral adjustment means, or it may be provided in addition to the lateral adjustment means 5 illustrated in FIG. 4 and FIG. 5*b*.

Although a preferred embodiment of the invention has been specifically illustrated and described herein, it is to be understood that minor variations may be made in the apparatus without departing from the spirit and scope of the invention, as defined by the appended claims.

What is claimed is:

1. A hinge (1) for furniture comprising:

a furniture frame-side hinge portion (4) configured to be fastened to a lateral face of a furniture frame (2) and a door-side hinge portion (6) configured to be fastened to a furniture door wing (3), the hinge portions (4,6) being jointedly connected, and at least one of the hinge portions (4, 6) comprising at least one of a height adjustment means (10) and a lateral adjustment means (5), the door-side hinge portion (6) includes a hinge cup (8) configured to be mounted in a recess in the furniture door wing (3), and that the height adjustment means (10) is arranged in the hinge cup (8) and includes at least one locking element (17) with which the set vertical position of the door wing (3) can be fixed relative to the furniture frame (2), the hinge portions (4,6) are jointedly connected by means of at least one link axis (7), and the height adjustment means (10) being configured to position the furniture door wing (3) relative to the furniture frame (2) along the link axis (7), and the lateral adjustment means (5) is arranged in and pivots the furniture frame-side hinge portion (4) around an imaginary pivot axis (11) located external of a flange part (37) of the furniture frame-side hinge portion (4) and on a side of the furniture frame-side hinge portion (4) that is fastened to the furniture frame (2) and the imaginary pivot axis (11) extending in parallel with the link axis (7), and the lateral adjustment means (5) being configured to position the furniture frame (2) relative to the door wing (3) along a direction perpendicular to the height position of the door wing (3).

2. The hinge of claim 1, characterized in that the furniture frame-side hinge portion (4) has a depth adjustment means (16), wherein the depth adjustment means (16) is configured to position the door wing (3) relative to the furniture frame side hinge portion (4) in a direction perpendicular to each of the lateral and depth directions.

3. The hinge of claim 2, characterized in that the depth adjustment means (16) has a releasable engagement means which, in the locking position, retains the furniture frame-side hinge portion (4) in a middle position relative to fastening screws (24) sitting in oval fastening holes (25) extending in the depth direction (11).

4. The hinge of claim 1, characterized in that the furniture frame-side hinge portion (4) comprises a fork member (9) receiving the link axis (7) and a connecting member (14) pivotably attached to the fork member (9).

5. The hinge of claim 1, characterized in that the connecting member (14) is engaged in the hinge cup (8), that it is displaceable within the hinge cup (8) along guide means (13) in the vertical direction, either manually or using a height adjustment element (12), and that it can be fixed at a desired position using the locking element (17).

6. The hinge of claim 1, characterized in that the part of the frame-side hinge portion (4) resting on the furniture frame (2) is of a plate-shaped design and has a low structural height with respect to the furniture frame (2) when installed.

7. The hinge of claim 1, characterized in that the furniture frame-side hinge portion (4) and the door-side hinge portion (6) are coupled by means of a clip connection (22).

8. The hinge of claim 7, characterized in that the clip connection (22) is arranged in the door-side hinge portion (6).

9. The hinge of claim 8, characterized in that a hinge cup (8) of the door-side hinge portion (6) receives the clip connection (22).

10. The hinge of claim 7, characterized in that a hinge cup (8) of the door-side hinge portion (6) receives the clip connection (22).

11. The hinge of claim 7, characterized in that the clip means (22) has a spring element (34) integral with the hinge cup (8) and, together with the furniture frame-side hinge portion (4), forming a catch connection allowing for the height adjustment of the door-side hinge portion (6) in the hinge cup (8).

12. The hinge of claim 1, characterized in that the height adjustment means (10) comprises at least one eccentric (15) supported at the hinge cup (8) such that the door-side hinge portion (6) changes its position in the vertical direction by a rotation of the eccentric.

13. The hinge of claim 1, characterized in that the locking element (17) is formed by a screw fixing a connecting member (14) at the present position when the screw is tightened.

14. The hinge of claim 1, characterized in that a cylindrical surface is provided for pivoting the furniture frame-side hinge portion (4), the cylinder axis thereof being the pivot axis (11).

15. A hinge cup (8) for a hinge (1) of claim 1, wherein a furniture frame-side hinge portion (4) and a door-side hinge portion (6) are connected through a clip connection (22), characterized in that the clip connection (22) comprises a spring element (34) integral with the hinge cup (8) and, together with the furniture frame-side hinge portion (4), forming a catch connection allowing for the height adjustment of the door-side hinge portion (6) in the hinge cup (8).

16. A hinge (1) for furniture comprising:

a furniture frame-side hinge portion (4) configured to be fastened to a lateral face of a furniture frame (2) and a door-side hinge portion (6) configured to be fastened to a furniture door wing (3), the hinge portions (4, 6) being jointedly connected, and at least one of the hinge portions (4, 6) comprising at least one of a height adjustment means (10) and a lateral adjustment means (5), that the door-side hinge portion (6) includes a hinge cup (8) configured to be mounted in a recess in the furniture door wing (3), and that the height adjustment means (10) is arranged in the hinge cup (8) and includes at least one locking element (17) with which the set vertical position of the door wing (3) can be fixed relative to the furniture frame (2), that the hinge portions (4,6) are jointedly connected by means of at least one link axis (7), and the height adjustment means (10) being configured to position the furniture door wing (3) relative to the furniture frame (2) along the link axis(7), and that the lateral adjustment means (5) is arranged in and pivots the furniture frame-side hinge portion (4) around an imaginary pivot axis (11) external of a flange part (37) of the furniture frame-side hinge portion (4) and on a side of the furniture frame-side hinge portion (4) that is fastened to the furniture frame (2) and the imaginary pivot axis (11) extending in parallel with the link axis (7), and the lateral adjustment means (5) being configured to position the furniture frame (2) relative to the door wing (3) along a direction perpendicular to the height position of the door wing (3),in that the height adjustment element (12) has a pinion (19) meshing with a straight toothing (21) of the guide means (13) in the hinge cup (8), which extends in parallel with the height adjustment means.

17. A hinge (1) for furniture comprising:

a furniture frame-side hinge portion (4) configured to be fastened to a lateral face of a furniture frame (2) and a door-side hinge portion (6) configured to be fastened to a furniture door wing (3), the hinge portions (4, 6) being jointedly connected, and at least one of the hinge portions (4, 6) comprising at least one of a height adjustment means (10) and a lateral adjustment means (5), the door-side hinge portion (6) includes a hinge cup (8) configured to be mounted in a recess in the furniture door wing (3), and that the height adjustment means (10) is arranged in the hinge cup (8) and includes at least one locking element (17) with which the set vertical position of the door wing (3) can be fixed relative to the furniture frame (2), the hinge portions (4,6) are jointedly connected by means of at least one link axis (7), and the height adjustment means (10) being configured to a position the door wing (3) relative to the furniture frame (2) along the link axis (7), and the lateral adjustment means (5) is arranged in and pivots the furniture frame-side hinge portion (4) around an imaginary pivot axis (11) located external of a flange part (37) of the furniture frame-side hinge portion (4) and on a side of the furniture frame-side hinge portion (4) that is fastened to the furniture frame (2) and the imaginary pivot axis (11) extending in parallel with the link axis (7), wherein the hinge (1) is a single axis hinge with the link axis (7), and the lateral adjustment means (5) being configured to position the furniture frame (2) relative to the door wing (3) along a direction perpendicular to the height position of the door wing (3).

* * * * *